US011334021B2

(12) United States Patent
Yamaguchi et al.

(10) Patent No.: US 11,334,021 B2
(45) Date of Patent: May 17, 2022

(54) IMAGE FORMING APPARATUS WITH A GEAR TRAIN FOR DEVELOPING ROLLERS AND A GEAR TRAIN FOR PHOTOSENSITIVE DRUMS

(71) Applicant: BROTHER KOGYO KABUSHIKI KAISHA, Nagoya (JP)

(72) Inventors: Wataru Yamaguchi, Nisshin (JP); Daisuke Ishizuka, Aichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/213,537

(22) Filed: Mar. 26, 2021

(65) Prior Publication Data

US 2021/0311428 A1 Oct. 7, 2021

(30) Foreign Application Priority Data

Apr. 1, 2020 (JP) ..... JP2020-065512
Apr. 27, 2020 (JP) ..... JP2020-078742
Jan. 13, 2021 (JP) ..... JP2021-003655

(51) Int. Cl.
*G03G 21/16* (2006.01)
*G03G 15/00* (2006.01)
*G03G 21/18* (2006.01)

(52) U.S. Cl.
CPC ..... *G03G 21/1647* (2013.01); *G03G 15/757* (2013.01); *G03G 21/1661* (2013.01); *G03G 21/1857* (2013.01)

(58) Field of Classification Search
CPC ..... G03G 15/757; G03G 21/1647; G03G 21/1661; G03G 21/1857
See application file for complete search history.

(56) References Cited

U.S. PATENT DOCUMENTS

2007/0092297 A1* 4/2007 Shimura ..... G03G 15/0194 399/167
2010/0028046 A1 2/2010 Abe et al.
2012/0251170 A1 10/2012 Hashimoto
(Continued)

FOREIGN PATENT DOCUMENTS

JP H09179372 A 7/1997
JP H10186777 A 7/1998
(Continued)

*Primary Examiner* — Sophia S Chen
(74) *Attorney, Agent, or Firm* — Merchant & Gould P.C.

(57) ABSTRACT

An image forming apparatus, having a first developing roller, a second developing roller, a third developing roller, a fourth developing roller, a first photosensitive drum, a second photosensitive drum, a third photosensitive drum, a fourth photosensitive drum, a motor, a first output gear, a first gear train, and a second gear train, is provided. The first output gear is arranged coaxially with the motor and outputs a driving force from the motor. The first gear train includes a first intermediate gear meshing with the first output gear and transmits the driving force from the motor through the first output gear to the first, second, third, and fourth developing rollers. The second gear train includes a second intermediate gear meshing with the first output gear and transmits the driving force from the motor through the first output gear to the first, second, third, and fourth photosensitive drums.

14 Claims, 8 Drawing Sheets

(56) References Cited

U.S. PATENT DOCUMENTS

| | | | | |
|---|---|---|---|---|
| 2012/0251184 | A1 | 10/2012 | Hashimoto | |
| 2014/0294476 | A1 | 10/2014 | Hashimoto et al. | |
| 2015/0093152 | A1* | 4/2015 | Hashimoto | G03G 21/1647 399/223 |
| 2015/0117910 | A1 | 4/2015 | Suzuki et al. | |
| 2017/0045856 | A1* | 2/2017 | Kawai | G03G 15/757 |
| 2020/0292959 | A1* | 9/2020 | Saeki | G03G 21/1647 |
| 2020/0310281 | A1* | 10/2020 | Haruta | G03G 21/1857 |
| 2021/0200140 | A1* | 7/2021 | Sano | G03G 21/1633 |

FOREIGN PATENT DOCUMENTS

| | | | |
|---|---|---|---|
| JP | 2003043780 | A | 2/2003 |
| JP | 2005010466 | A | 1/2005 |
| JP | 2005134732 | A | 5/2005 |
| JP | 2007078720 | A | 3/2007 |
| JP | 2009157091 | A | 7/2009 |
| JP | 2010186155 | A | 8/2010 |
| JP | 2011085950 | A | 4/2011 |
| JP | 2012212074 | A | 11/2012 |
| JP | 2012215603 | A | 11/2012 |
| JP | 2014199368 | A | 10/2014 |
| JP | 2015087585 | A | 5/2015 |

* cited by examiner

IMAGE FORMING APPARATUS WITH A GEAR TRAIN FOR DEVELOPING ROLLERS AND A GEAR TRAIN FOR PHOTOSENSITIVE DRUMS

CROSS REFERENCE TO RELATED APPLICATION

This application claims priority from Japanese Patent Applications Nos. 2021-003655, filed on Jan. 13, 2021; 2020-065512, filed on Apr. 1, 2020; and 2020-078742, filed on Apr. 27, 2020; the entire subject matters of which are incorporated herein by reference.

BACKGROUND

Technical Field

An aspect of the present disclosure is related to an image forming apparatus.

Related Art

An electro-photographic image forming apparatus such as a tandem-formation printer having a plurality of developing units for colors of yellow, magenta, cyan, and black, is known. The tandem-formation printer may drive the developing unit for black for monochrome printing separately from the developing units for yellow, magenta, and cyan for multicolor printing.

SUMMARY

In the known image forming apparatus, the developing unit for black may be driven by a motor, which may simultaneously drive another device in the image forming apparatus, such as a fuser. For example, at an intermediate position in a gear train that may transmit a driving force from the motor to the fuser, another gear train may be diverged to transmit the driving force from the motor to the developing unit for black. In this arrangement, while the fuser may require a greater driving force, gears and other parts in the fuser subject to the greater driving force may occasionally rotate unevenly, and the uneven rotation may be transmitted to the developing unit for black through the diverged gear train. As a result, banding may appear in a printed outcome.

The present disclosure is advantageous in that an image forming apparatus capable of multicolor printing and monochrome printing, in which a single motor may drive all of a plurality of developing rollers and all of plurality of photosensitive drums, while gear trains to drive the developing rollers and a gear train to drive the photosensitive drums are directly diverged from the motor, and in which banding may be restrained, is provided.

According to an aspect of the present disclosure, an image forming apparatus, having a first developing roller, a second developing roller, a third developing roller, a fourth developing roller, a first photosensitive drum, a second photosensitive drum, a third photosensitive drum, a fourth photosensitive drum, a motor, a first output gear, a first gear train, and a second gear train, is provided. Each of the first developing roller, the second developing roller, and the third developing roller carries a developing agent in one of different colors other than black. The fourth developing roller carries a developing agent in black. The first photosensitive drum corresponds to the first developing roller. The second photosensitive drum corresponds to the second developing roller. The third photosensitive drum corresponds to the third developing roller. The fourth photosensitive drum corresponds to the fourth developing roller. The motor drives the first developing roller, the second developing roller, the third developing roller, the fourth developing roller, the first photosensitive drum, the second photosensitive drum, the third photosensitive drum, and the fourth photosensitive drum. The first output gear is arranged coaxially with the motor and outputs a driving force from the motor. The first gear train includes a first intermediate gear meshing with the first output gear. The first gear train transmits the driving force from the motor through the first output gear to the first developing roller, the second developing roller, the third developing roller, and the fourth developing roller. The second gear train includes a second intermediate gear meshing with the first output gear. The second gear train transmits the driving force from the motor through the first output gear to the first photosensitive drum, the second photosensitive drum, the third photosensitive drum, and the fourth photosensitive drum.

BRIEF DESCRIPTION OF THE ACCOMPANYING DRAWINGS

DETAILED DESCRIPTION

Hereinafter, an embodiment of the present disclosure will be described with reference to the accompanying drawings.

Figure 1:
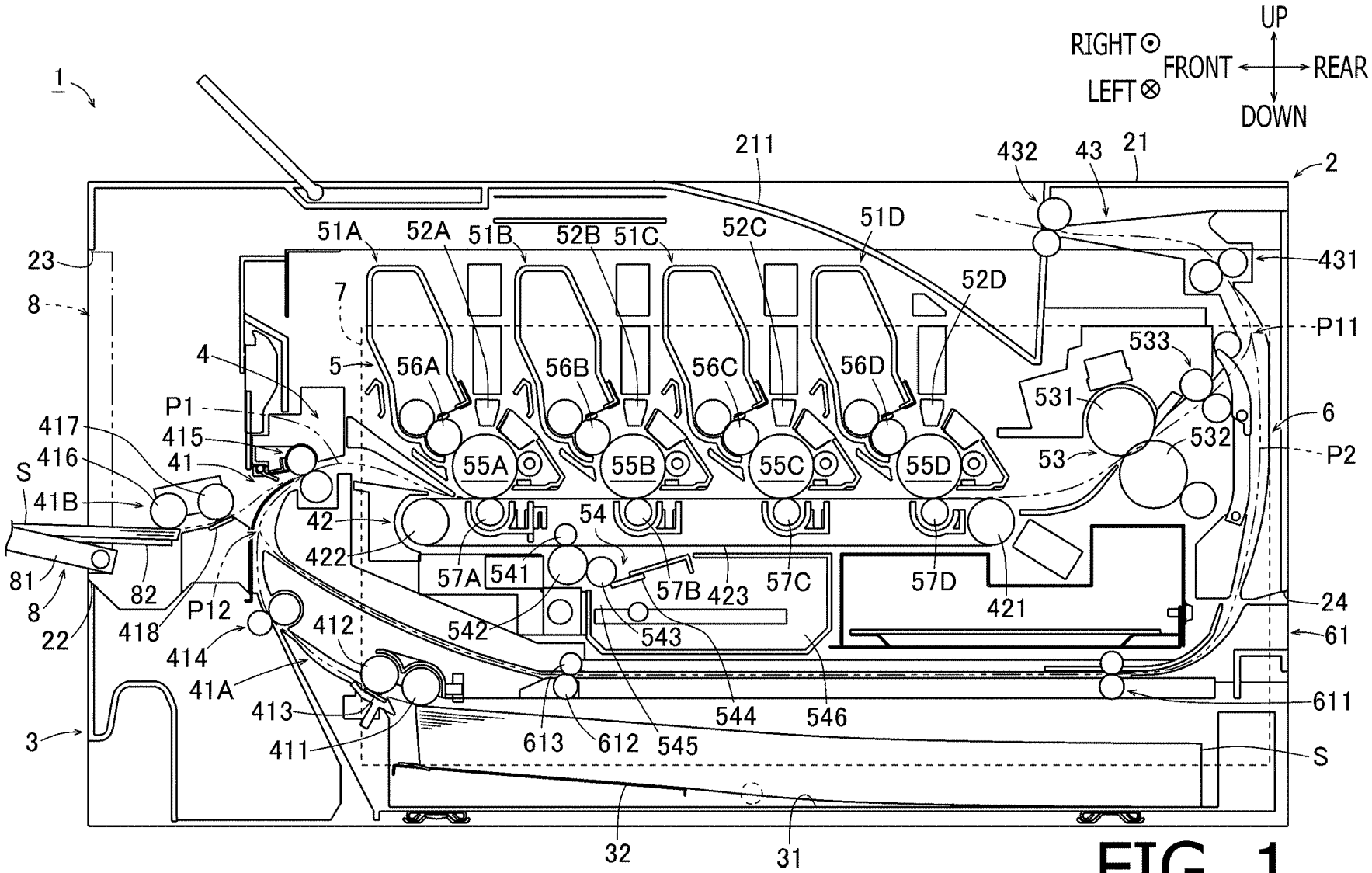
FIG. 1 is an overall cross-sectional view of an image forming apparatus according to an embodiment of the present disclosure.

In the following description, directions related an image forming apparatus 1 and each part or item included in the image forming apparatus 1 will be referred to on basis of indications by arrows in the drawings. For example, in FIG. 1, a viewer's a left-hand side and a right-hand side will be referred to as a front side and a rear side, respectively, for the image forming apparatus 1. A nearer side and a farther side to the viewer viewing FIG. 1 will be referred to as a rightward side and a leftward side to the image forming apparatus 1, respectively. An upper side and a lower side to the viewer viewing FIG. 1 will be referred to as an upper side and a lower side for the image forming apparatus 1, respectively. A front-to-rear or a rear-to-front direction may be referred to as a front-rear direction, a left-to-right or right-to-left direction may be referred to as a widthwise direction, and an up-to-down or down-to-up direction may be referred to as a vertical direction.

[Overall Configuration of the Image Forming Apparatus]

The image forming apparatus 1 has a body 2, which is a substantially rectangular housing forming an overall exterior appearance of the image forming apparatus 1. The body 2 includes a body frame, which is not shown, to support parts and members in the image forming apparatus 1, and a body cover 21, which may cover the body frame and form a part of the exterior appearance of the image forming apparatus 1. The body frame includes a left-side frame 20 (see FIG. 2) and a right-side frame (not shown), which are arranged on the left and the right, respectively. The body cover 21 includes an ejection tray 221 on an upper side thereof.

The image forming apparatus 1 is a multicolor laser printer capable of forming a multicolored image on a sheet S, such as a paper sheet and an OHP sheet, electro-photographically. The body 2 may accommodate a sheet tray 3, a conveyer 4, an image forming device 5, a duplex conveyer 6, a driving device 7, and a multipurpose (MP) tray 8. In the body 2, the image forming device 5 may range in upper to central areas, the conveyer 4 may be located rearward with respect to the image forming device 5, the duplex conveyer 6 may range from a frontward to rearward areas in the body 2 and in a lower area with respect to the conveyer 4, the sheet tray 3 may be located at a lower position with respect to the duplex conveyer 6, the driving device 7 may range in a leftward area with respect to the sheet tray 3 and the duplex conveyer 6, and the MP tray 8 may be located frontward with respect to the image forming device 5.

On a front side of the main body 2, at a lower position, formed is an opening 22, through which the sheet tray 3 may be inserted. The sheet tray 3 includes a sheet container 31, which may be in a form of a top-open box, and a lifting plate 32, which may support the sheet(s) S vertically movably. The sheet tray 3 is movable in the front-rear direction through the opening 22 to be detached from or attached to the body 2.

On the front side of the body 2, at an upper position with respect to the opening 22, formed is an opening 23, in which the MP tray 8 may be stowed. The MP tray 8 includes a tray 81, which is pivotable about a fulcrum point on a lower edge of the opening 23 to open or close, and a lifting plate 82, which may support the sheet(s) S vertically movably. The MP tray 8 is swingable between a closed position (drawn by dash-and-dotted lines in FIG. 1), in which the MP tray 8 closes the opening 23, and an open position (drawn by solid lines in FIG. 1), in which the MP tray 8 exposes the opening 23. The MP tray 8 may, when at the open position, support a stack of sheets S thereon.

The conveyer 4 includes members that are arranged along a conveyer path P1 and may convey the sheet S along the conveyer path P1. The conveyer path P1 extends from the sheet tray 3 and from the MP tray 8 through the image forming device 5 to the ejection tray 211. The conveyer 4 includes a feeder 41, a belt conveyer 42, and an ejection device 43, which are arranged along the conveyer path P1 in this recited order from upstream to downstream in a conveying direction to convey the sheet S.

The feeder 41 includes a feeder device 41A, which may pick up and separate one of the sheets S stored in the sheet tray 3 and convey the separated one of the sheet S; a feeder device 41B, which may pick up and separate one of the sheets S stacked on the MP tray 8 and convey the separated one of the sheets S; and a registration roller pair 415.

The feeder device 41A includes a feed roller 411, a separation roller 412, a separation pad 413, and a conveyer roller pair 414. The sheets S stored in the sheet tray 3 may be separately conveyed and fed to the conveyer path P1 by the feed roller 411, the separation roller 412, and the separation pad 413. The sheet S fed to the conveyer path P1 may be conveyed by the conveyer roller pair 414 and the registration roller pair 415 toward the image forming device 5.

The feeder device 41B includes a feed roller 416, a separation roller 417, and a separation pad 418. The sheets S stacked on the MP tray 8 may be separately conveyed and fed to the conveyer path P1 by the feed roller 416, the separation roller 417, and the separation pad 418. The sheet S fed to the conveyer path P1 may be conveyed by the registration roller pair 415 toward the image forming device 5.

The belt conveyer 42 includes a driving roller 421, a driven roller 422, and a conveyer belt 423. The driving roller 421 may rotate in conjunction with the image forming device 5. The driven roller 422 is rotatably arranged at a position separated from the driving roller 421. The conveyer belt 423 is strained around the driving roller 421 and the driven roller 422. With the sheet S placed on the conveyer belt 423, the conveyer belt 423 may roll and convey the sheet S along the conveyer path P1 through an area below the image forming device 5, in which the sheet S being conveyed faces first through fourth photosensitive drums 55A-55D. The conveyer belt 423 may convey the sheet S further toward the fuser 53.

The ejection device 43 includes an intermediate ejection roller pair 431 and an ejection roller pair 432, which are arranged between a diverging position P11 in the conveyer path P1 and the ejection tray 211. The intermediate ejection roller pair 431 and the ejection roller pair 432 are switchback rollers, which may rotate bidirectionally in a normal direction and a reverse direction. In order to eject the sheet S conveyed through the fuser 53 outside at the ejection tray 211, the intermediate ejection roller pair 431 and the ejection roller pair 432 may rotate in the normal direction, and in order to reverse the sheet S upside-down and convey to a duplex conveyer path P2, the intermediate ejection roller pair 431 and the ejection roller pair 432 may rotate in the reverse direction.

The image forming device 5 is a so-called direct tandem-formation printer capable of both multicolor printing and monochrome printing. The image forming device 5 includes a first drum unit 51A, a second drum unit 51B, a third drum unit 51C, and a fourth drum unit 51D, which are arranged adjacent to one another to align along the front-rear direction in this recited order. In other words, the first drum unit 51A is arranged at a most frontward position, and the fourth drum unit 51D is arranged at a most rearward position in the front-rear direction. Moreover, the image forming device 5 includes a first exposure LED head 52A, a second exposure LED head 52B, a third exposure LED head 52C, and a fourth exposure LED head 52D; which are arranged adjacent to one another to align along the front-rear direction in this recited order. Moreover, the image forming device 5 includes the fuser 53 and a belt cleaner 54.

The first drum unit 51A, the second drum unit 51B, the third drum unit 51C, and the fourth drum unit 51D correspond to toners, i.e., developing agents, in different colors of yellow, magenta, cyan, and black, respectively. The first drum unit 51A includes a first photosensitive drum 55A, a first developing roller 56A, and a first transfer roller 57A facing toward the first photosensitive drum 55A across the conveyer belt 423.

Similarly, the second drum unit 51B includes a second photosensitive drum 55B, a second developing roller 56B, and a second transfer roller 57B facing toward the second photosensitive drum 55B across the conveyer belt 423. The third drum unit 51C includes a third photosensitive drum 55C, a third developing roller 56C, and a third transfer roller 57C facing toward the third photosensitive drum 55C across the conveyer belt 423. The fourth drum unit 51D includes a fourth photosensitive drum 55D, a fourth developing roller 56D, and a fourth transfer roller 57D facing toward the fourth photosensitive drum 55D across the conveyer belt 423.

In the image forming device 5 configured as above, surfaces of the first through fourth photosensitive drums 55A-55D uniformly charged by chargers may be selectively exposed to beams emitted from the first through fourth exposure LED heads 52A-52D. From the selectively exposed areas on the surfaces of the first through fourth photosensitive drums 55A-55D, the charges may be removed, and electrostatic latent images may be formed on the surfaces of the first through fourth photosensitive drums 55A-55D.

Meanwhile, developing biases may be applied to the first through fourth developing rollers 56A-56D, and the first through fourth developing rollers 56A-56D carry toners in yellow, magenta, cyan, and black, respectively, on the surfaces thereof. When the electrostatic latent images formed on the surfaces of the first through fourth photosensitive drums 55A-55D face the first through fourth developing rollers 56A-56D, respectively, due to the difference in potentials between the electrostatic latent images and the first through fourth developing rollers 56A-56D, the toners may be supplied to the electrostatic latent images from the first through fourth developing rollers 56A-56D, respectively. Thereby, the toner images may be formed on the surfaces of the first through fourth photosensitive drums 55A-55D.

The sheet S conveyed to the image forming device 5 may be further conveyed by the conveyer belt 423 to pass through the area between the conveyer belt 423 and the first through fourth photosensitive drums 55A-55D to face the first through fourth photosensitive drums 55A-55D one after another. The toner imagers on the surfaces of the first through fourth photosensitive drums 55A-55D facing the sheet S may be transferred to the sheet S one after another by transferring biases applied to the first through fourth transfer rollers 57A-57D.

The fuser 53 is located on the conveyer path P1 at a downstream position in the conveying direction with respect to the fourth photosensitive drum 55D. The fuser 53 includes a heat roller 531 and a pressure roller 532, which is urged against the heat roller 531. The heat roller 531 is arranged on a same side of the sheet S as a side, on which the images are formed. The heat roller 531 may be driven to rotate synchronously with the conveyer belt 423 and apply heat and a conveying force to the sheet S.

On the other hand, the pressure roller 532 is located on a side opposite to the heat roller 531 across the sheet S and may press the sheet S against the heat roller 531. Therefore, the pressure roller 532 may receive a rotating force to passively rotate from the heat roller 531 through the sheet S contacting the heat roller 531.

The fuser 53 includes a fuser-ejecting roller pair 533, which is located at a downstream position in the conveying direction with respect to the heat roller 531 and the pressure roller 532.

The sheet S with the toner images transferred thereon through the image forming device 5 may be conveyed between the heat roller 531 and the pressure roller 532, at which the toner images may be thermally fixed to the sheet S. The sheet S with the thermally fixed toner images may be nipped and conveyed by the fuser-ejecting roller pair 533 to the intermediate ejection roller pair 431.

The belt cleaner 54 is located between the blet conveyer 42 and the duplex conveyer 6 and may collect waste toner from the conveyer belt 423.

The belt cleaner 54 includes a backup roller 541, a cleaning roller 542, a collecting roller 543, a scraper blade 544, a collecting compartment 545, and a waste toner box 546.

The backup roller 541 is arranged on an inner side of the conveyer belt 423 to contact the conveyer belt 423 from an upper side. The cleaning roller 542 is arranged at a position to face toward the backup roller 541 across the conveyer belt 423 and contacts the conveyer belt 423 from a lower side.

In the belt cleaner 54, the waste toner adhered to the conveyer belt 423 may be collected by the cleaning roller 542, the collecting roller 543, the scraper blade 544, and the collecting compartment 545, and the collected waste toner may be stored in the waste toner box 546.

A cleaning action may start after forming images on the sheet S by the image forming device 5. In the cleaning action, the waste toner adhered to the surface of the conveyer belt 423 may be removed by a bias applied to the cleaning roller 542 to stay on a surface of the cleaning roller 542 electrostatically and may be transferred electrostatically to the collecting roller 543. The waste toner transferred to the collecting roller 543 may be scraped off by the scraper blade 544 and fall in the collecting compartment 545. The waste toner fallen in the collecting compartment 545 may be conveyed rearward by a conveyer, which is not shown, to be stored in the waste toner box 546.

The duplex conveyer 6 includes members that are arranged along the duplex conveyer path P2 and may convey the sheet S along the duplex conveyer path P2. The duplex conveyer path P2 is diverged from the conveyer path P1 at the diverging position P11, which is between the fuser 53 and the intermediate ejection roller pair 431 along the conveyer path P1, extending through an area above the sheet tray 3 and merging with the conveyer path P1 at a merging position P12, which is between the sheet tray 3 and the image forming device 5. In this arrangement of the duplex conveyer 6, the duplex conveyer path P2 may be shortened compared to a duplex conveyer arranged in an area below the sheet tray 3.

The duplex conveyer 6 includes a detachable duplex conveyer unit 61 at a position higher than the sheet tray 3 and lower than the image forming device 5. The duplex conveyer unit 61 includes a skew-conveyer roller pair 611 and a duplex conveyer roller 612 to guide the sheet S along a duplex conveyer path P2. At a position on the body 2 above the duplex conveyer roller 612, arranged is a driven roller 613, which may nip the sheet S together with the duplex conveyer 612.

On a rear side of the body 2, formed is an opening 24, through which the duplex conveyer unit 61 is movable. The duplex conveyer unit 61 may be moved through the opening 24 in the front-rear direction to be attached to or detached from the body 2. Meanwhile, however, location of the duplex conveyer unit 61 may not necessarily be limited. For example, the duplex conveyer unit 61 may be located below the sheet tray 3.

The duplex conveyer 6 may convey the sheet S, on one side of which the image is formed, conveyed by the intermediate ejection roller pair 431, to the merging position P12. The sheet S may be conveyed through the merging position P12 to return to the image forming device 5, in which another image may be formed on the other side of the sheet S. Thereafter, the sheet S may be ejected by the ejection device 43 at the ejection tray 211. Meanwhile, when the sheet S is jammed in the duplex conveyer 6, a user may remove the duplex conveyer unit 61 from the body 2 to access the jammed sheet S and clear the sheet jam.

Thus, the image forming apparatus 2 is capable of so-called double-side printing, in which the image forming device 5 may form an image on one side of the sheet S, and the sheet S may be conveyed through the duplex conveyer P2 to return to the image forming device 3, and another image may be formed on the other side of the sheet S.

The driving device 7 include an electric motor and gear trains, which may be arranged on a leftward face of the leftward frame 20 and may drive the sheet tray 3, the conveyer 4, the image forming device 5, the duplex conveyer 6, and the MP tray 8. In the following paragraphs, the driving device 7 and a configuration to restrain banding will be described in detail.

[Driving Device]

The driving device 7 includes, as shown in FIGS. 2-5, a first driving unit 71, a second driving unit 72, a first cover 73, a second cover 74, and a metal plate member 75.

<First Driving Unit>

The first driving unit 71 may drive the lifting plate 32 in the sheet tray 3, the lifting plate 82 in the MP tray 8, the feeder 41, the fuser 53, the ejection device 43, and the duplex conveyer 6. The first driving unit 71 includes a main motor 76 (see FIG. 3) and a first driving-force transmission assembly 77 (see FIGS. 4 and 5). The first driving-force transmission assembly 77 includes a plurality of gear trains 771-773, which may transmit a driving force from the main motor 76 to the lifting plate 32 in the sheet tray 3, the lifting plate 82 in the MP tray 8, the feeder 41, the fuser 53, the ejection device 43, and the duplex conveyer 6.

<Second Driving Unit>

The second driving unit 72 may drive the belt conveyer 42, the first through fourth drum units 51A-51D, and the belt cleaner 54. The second driving unit 72 is separated from, or not connected with, the first driving unit 71, which may drive the members subjected to a greater load, including the fuser 53. Rather, the second driving unit 72 may drive the members, including the first through fourth drum units 51A-51D, which may directly affect the imaging qualities of the image forming apparatus 1. Therefore, uneven rotation in the first driving unit 71 may not be transmitted to the second driving unit 72, and banding may be restrained.

Figure 4:
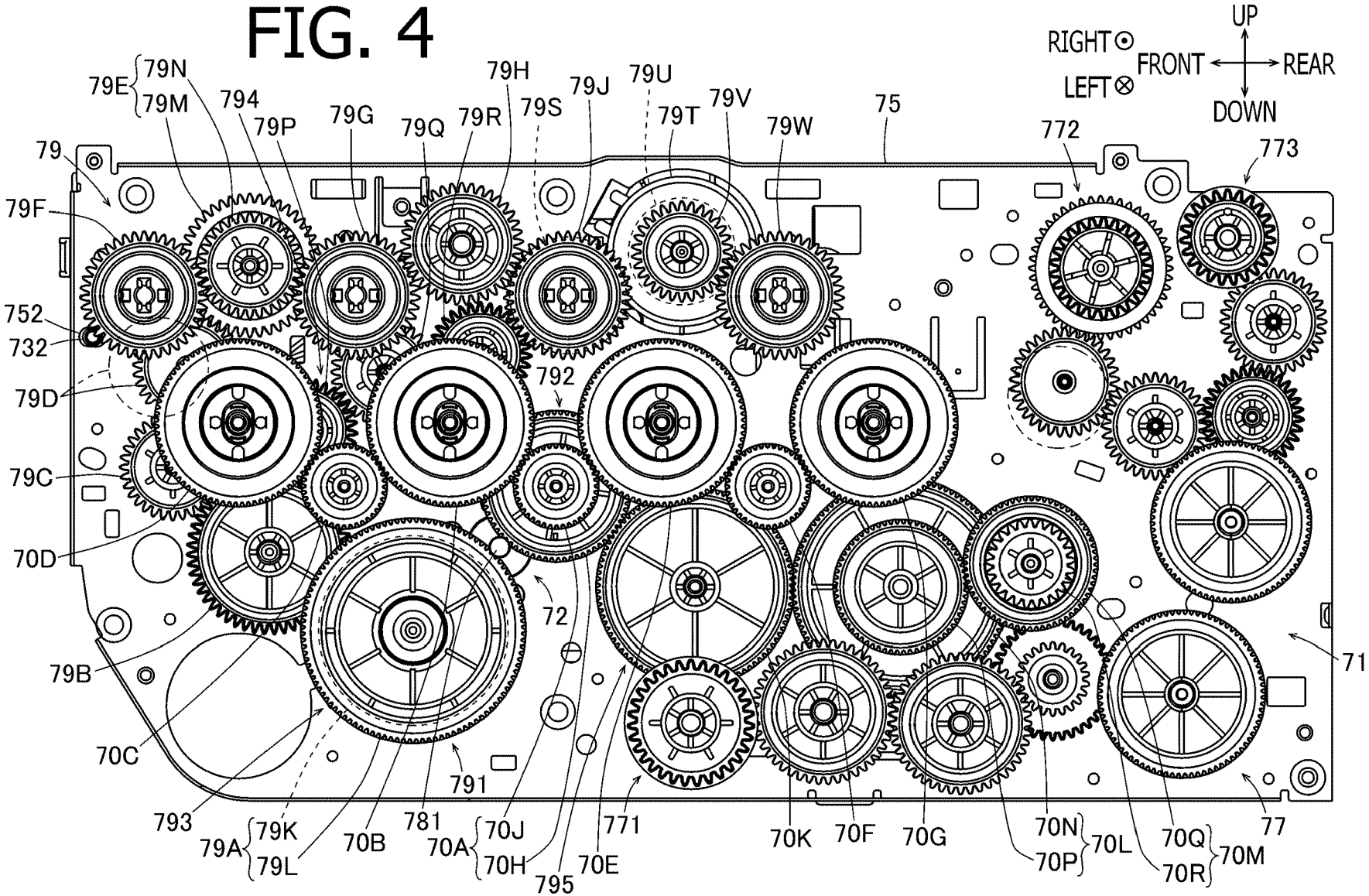
FIG. 4 is a rightward side view of the driving device, with a main motor and covers being omitted, in the image forming apparatus according to the embodiment of the present disclosure.
Figure 5:
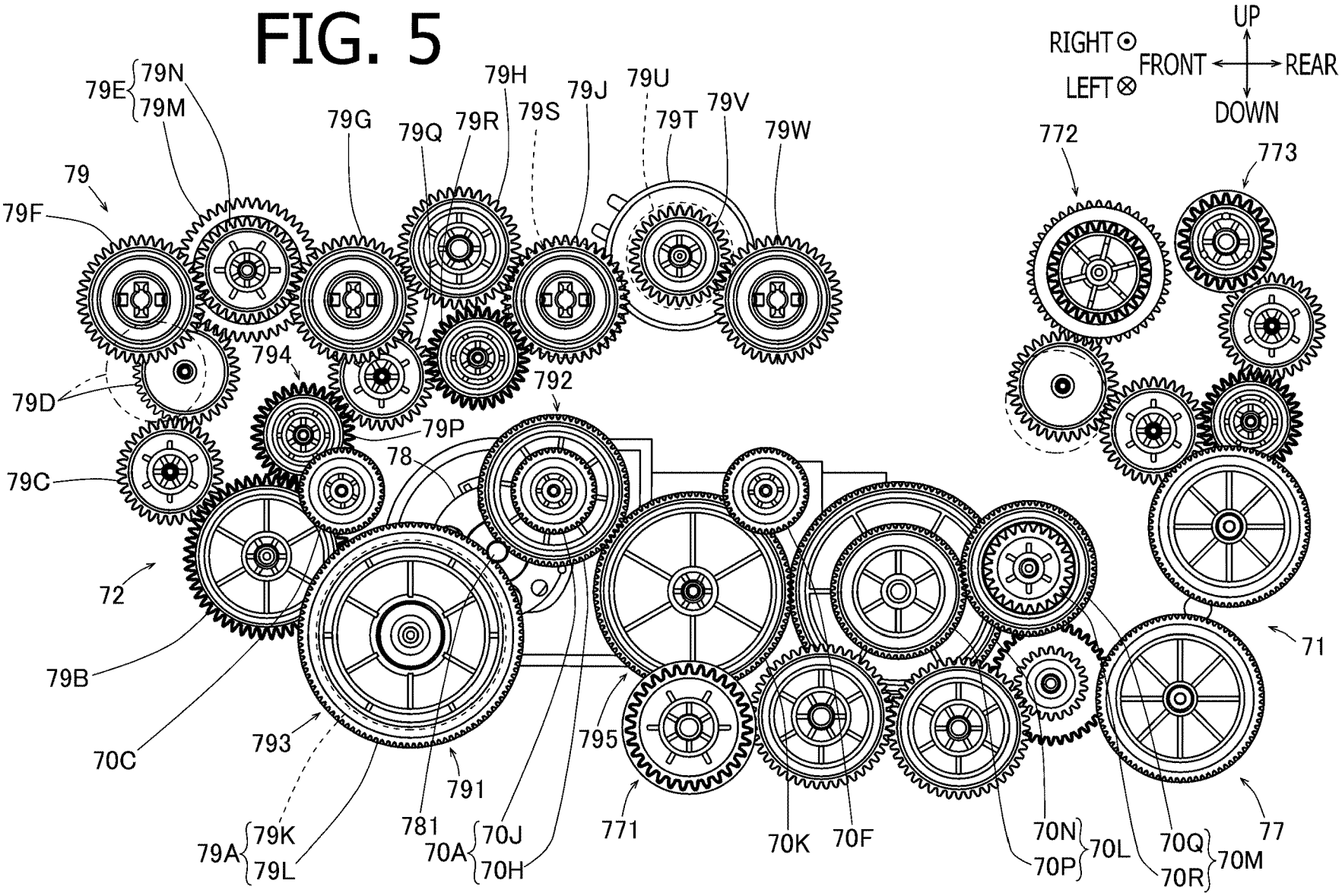
FIG. 5 is a rightward side view of the driving device, with the main motor, the covers, a metal plate member, and photosensitive drums being omitted, in the image forming apparatus according to the embodiment of the present disclosure.
Figure 6:
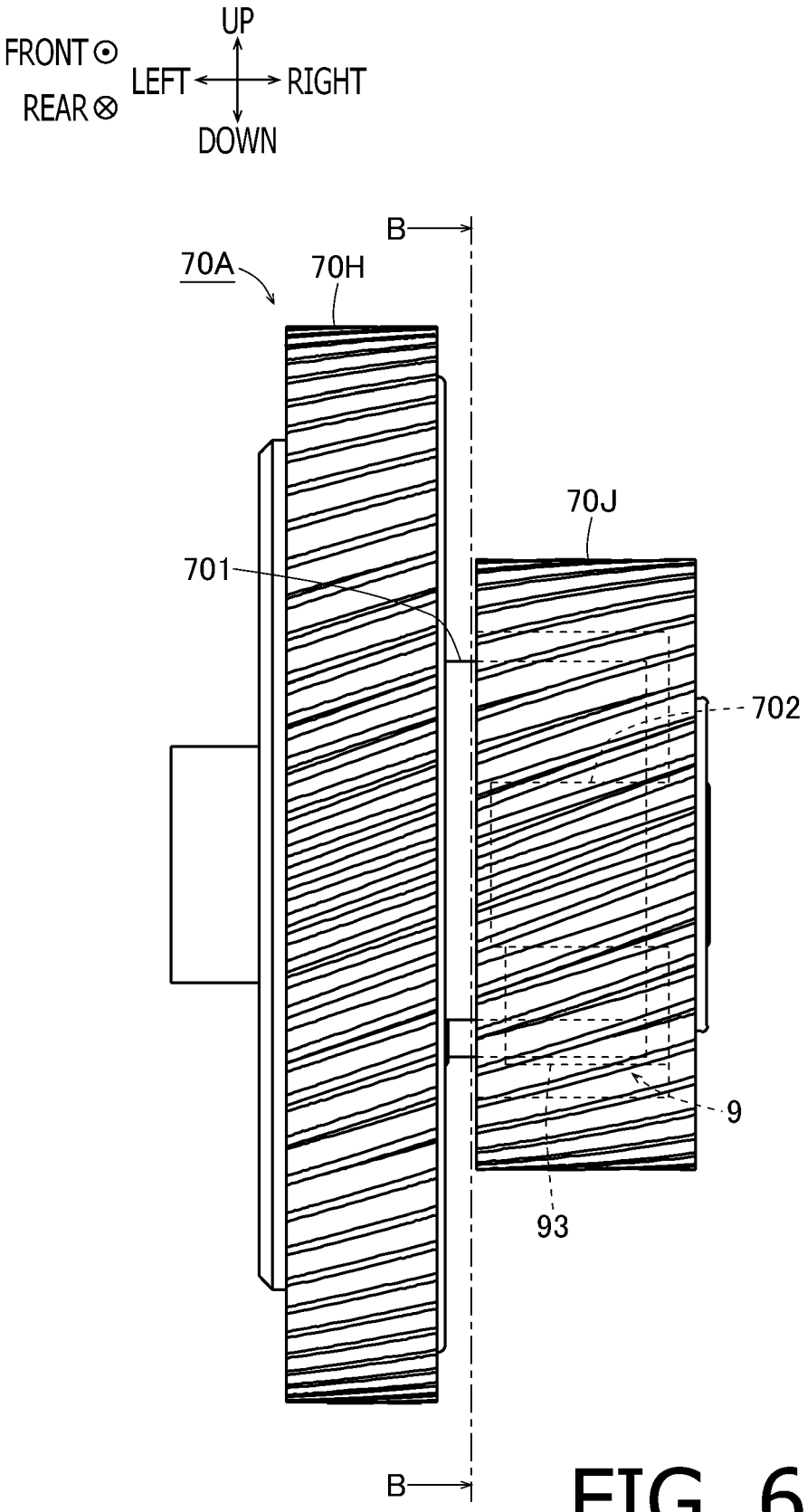
FIG. 6 is a frontward view of a second intermediate gear in the image forming apparatus according to the embodiment of the present disclosure.

As shown in FIGS. 4 and/or 5, the second driving unit 72 includes a process motor 78, a first output gear 781, and a second driving-force transmission assembly 79. The first output gear 781 is arranged coaxially with the process motor 78 and may output a driving force from the process motor 78. The first output gear 781 may be fixed to a rotation shaft of the process motor 78. The second driving-force transmission assembly 79 includes a first gear train 791, a second gear train 792, and a fifth gear train 795 to transmit the driving force from the process motor 78 to the belt conveyer 42, the first through fourth drum units 51A-51D, and the belt cleaner 54.

(First Gear Train)

The first gear train 791 may transmit the driving force from the process motor 78 to the first developing roller 56A, the second developing roller 56B, the third developing roller 56C, and the fourth developing roller 56D. The first gear train 791 includes a third gear train 793, which may transmit the driving force to the first developing roller 56A, the second developing roller 56B, and the third developing roller 56C; and a fourth gear train 794, which may transmit the driving force the fourth developing roller 56D.

(Third Gear Train)

The third gear train 793 includes a first intermediate gear 79A meshing with the first output gear 781, a third intermediate gear 79B meshing with the first intermediate gear 79A, a gear 79C meshing with the third intermediate gear 79B, and a pendulum gear 79D, which may mesh with the gear 79C. The third gear train 793 further includes a gear 79E, which may mesh with the pendulum gear 79D, a gear 79F meshing with the gear 79E, a gear 79G meshing with the gear 79E, a gear 79H meshing with the gear 79G, and a second output gear 79J meshing with the gear 79H.

The first intermediate gear 79A is a two-wheeler gear, in which an input gear 79K on the right and an output gear 79L on the left are formed integrally. The input gear 79K meshes with the first output gear 781, and the output gear 79L meshes with the third intermediate gear 79B. Alternatively, the first intermediate gear 79A may be a single-wheeler gear meshing both with the first output gear 781 and the third intermediate gear 79B. The first intermediate gear 79A may, further, output the driving force to the belt cleaner 54.

The gear 79F is arranged coaxially with the first developing roller 56A and may output the driving force to the first developing roller 56A. The gear 79G is arranged coaxially with the second developing roller 56B and may output the driving force to the second developing roller 56B. The second output gear 79J is arranged coaxially with the third developing roller 56C and may output the driving force to the third developing roller 56C.

The gear 79E is a two-wheeler gear, in which an input gear 79M on the left and an output gear 79N on the right are formed integrally. The input gear 79M may mesh with the pendulum gear 79D, and the output gear 79N meshes with the gear 79F and the gear 79G. Alternatively, the gear 79E may be a single-wheeler gear, which may mesh with the pendulum gear 79D and meshes with the gears 79F, 79G.

The pendulum gear 79D is located at a position upstream from the first developing roller 56A, the second developing roller 56B, and the third developing roller 56C in a transmission flow of the driving force and may output the driving force to the first developing roller 56A, the second developing roller 56B, and the third developing roller 56C. The pendulum gear 79D is swingable between a first position, as drawn in solid lines in FIGS. 4 and 5, in which the pendulum gear 79D meshes with the input gear 79M to transmit the driving force to the input gear 79M, and a second position, as drawn in dash-and-dots lines in FIGS. 4 and 5, in which the pendulum gear 79D is separated from the input gear 79M to disconnect the driving force.

In this arrangement, when the pendulum gear 79D is at the first position, the image forming apparatus 1 may perform multicolor printing, and when the pendulum gear 79D is at the second position, the image forming apparatus 1 may perform monochrome printing. With the arrangement of the pendulum gear 79D that may transmit or disconnect the driving force easily, a manufacturing cost may be restrained from increasing.

(Fourth Gear Train)

The fourth gear train 794 includes a gear 79P meshing with the third intermediate gear 79B, a gear 79Q meshing with the gear 79P, a gear 79R meshing with the gear 79Q, a gear 79S meshing with the gear 79R, and an electromagnetic clutch 79U. Moreover, the fourth gear train 794 includes a clutch-input gear 79T, which meshes with the gear 79S and may input the driving force to the electromagnetic clutch 79U, a clutch-output gear 79V, which may output the driving force to the electromagnetic clutch 79U, and a third output gear 79W, which meshes with the clutch-output gear 79V.

The gear 79S is arranged on the leftward side of the second output gear 79J coaxially with the second output gear 79J. The gear 79S and the second output gear 79F are formed separately and may rotate individually from each other. Meanwhile, however, the gears to be arranged coaxially may not necessarily be limited to the gear 79S and the second output gear 79F as long as one of the gears in the third gear train 793 and one of the gears in the fourth gear train 794 are arranged coaxially. With one of the gears in the third gear train 793 and one of the gears in the fourth gear train 794 being arranged coaxially, i.e., at positions coincident with each other, the first gear train 791 may be downsized.

The third output gear 79W is arranged coaxially with the fourth developing roller 56D and may output the driving force to the fourth developing roller 56D.

The electromagnetic clutch 79U is located upstream from the fourth developing roller 56D in the transmission flow of the driving force and may output the driving force to the fourth developing roller 56D. The electromagnetic clutch 79U may shift between a first state, in which the electromagnetic clutch 79U may transmit the driving force to the fourth developing roller 56D, and a second state, in which the electromagnetic clutch 79U disconnects the driving force. Therefore, when the electromagnetic clutch 79U is in the first state, the image forming apparatus 1 may perform either the monochrome printing or the multicolor printing. With the electromagnetic clutch 79U that may transmit or disconnect the driving force, space-efficiency in the image forming apparatus 1 may be improved.

The clutch-input gear 79T is located on a leftward side of the electromagnetic clutch 79U, and the clutch-output gear 79V is arranged on a leftward side of the clutch-input gear 79T coaxially with the clutch-input gear 79T. It may be preferable that a quantity of teeth in the clutch-output gear 79V is different from a quantity of teeth in the clutch-input gear 79T. In the present embodiment, the quantity of the teeth in the clutch-output gear 79V is smaller than the quantity of the teeth in the clutch-input gear 79T. However, the quantity of the teeth in the clutch-output gear 79V may be larger than the quantity of the teeth in the clutch-input gear 79T.

With the difference in the quantities of the teeth between the clutch-input gear 79T and the clutch-output gear 79V, a rotation velocity may be reduced or increased through the electromagnetic clutch 79F. Therefore, rotation of the clutch-output gear 79V may be stabilized, and the imaging quality of the fourth drum unit 51D may be improved.

The fourth gear train 794 has the gear 79P meshing with the third intermediate gear 79B, which forms a part of the third gear train 793. In other words, at the third intermediate gear 79B, the fourth gear train 794 is diverged from the third gear train 793. The third intermediate gear 79B is at a relatively upstream position within the third gear train 793 in the transmission flow of the driving force. Therefore, with the fourth gear train 79 diverged from the third gear train 793 at the third intermediate gear 79B, which is relatively close to the first output gear 781 fixed to the rotation shaft of the process motor 78 being a source of the driving force, uneven rotation of the gears occurring in one of the third gear train 793 and the fourth gear train 794 may be restrained from being transmitted to the other of the third gear train 793 and the fourth gear train 794. In this regard, the gears in the other of the third gear train 793 and the fourth gear train 794 may rotate stably. Moreover, compared to a hypothetical configuration, in which the fourth gear train 794 is diverged directly from the first output gear 781, the fourth gear train 794 may be shortened.

Optionally, however, the fourth gear train 794 may not necessarily be diverged from the third gear train 793 at the third intermediate gear 79B but may be diverged at, for example, the first output gear 781 or the gear 79C, as long as the fourth gear train 794 is diverged from one of the gears on an upstream side from the pendulum gear 79D in the third gear train 793.

(Second Gear Train)

The second gear train 792 may transmit the driving force from the process motor 78 to the first photosensitive drum 55A, the second photosensitive drum 55B, the third photosensitive drum 55C, and the fourth photosensitive drum 55D. The second gear train 792 includes a second intermediate gear 70A meshing with the first output gear 781, a gear 70B meshing with the second intermediate gear 70A, a gear 70C meshing with the gear 70B, and a gear 70D meshing with the gear 70C. Moreover, the second gear train 792 includes a gear 70E meshing with the second intermediate gear 70A, a gear 70F meshing with the gear 70E, and a gear 70G meshing with the gear 70F.

The second intermediate gear 70A is a two-wheeler gear, in which an input gear 70H on the left and an output gear 70J on the right are formed integrally. The input gear 70H meshes with the first output gear 781, and the output gear 70J meshes with the gear 70B and the gear 70E.

The gear 70D is arranged coaxially with the first photosensitive drum 55A and may output the driving force to the first photosensitive drum 55A. The gear 70B is arranged coaxially with the second photosensitive drum 55B and may output the driving force to the second photosensitive drum 55B. The gear 70E is arranged coaxially with the third photosensitive drum 55C and may output the driving force to the third photosensitive drum 55C. The gear 70G is arranged coaxially with the fourth photosensitive drum 55D and may output the driving force to the fourth photosensitive drum 55D.

The first gear train 791 and the second gear train 792 are, as described above, in the arrangement such that both the first intermediate gear 79A in the first gear train 791 and the second intermediate gear 70A in the second gear train 792 mesh directly with the first output gear 781, which is fixed to the rotation shaft of the process motor 78. In this arrangement, the first gear train 791 to drive the first through fourth developing rollers 56A-56D and the second gear train 792 to drive the first through fourth photosensitive drums 55A-55D are directly diverged from the process motor 78; therefore, uneven rotation occurring in one of the first gear train 791 and the second gear train 792 may not be easily transmitted to the other of the first gear train 791 and the second gear train 792, and banding may be restrained.

(Fifth Gear Train)

The fifth gear train 795 may transmit the driving force from the process motor 78 to the belt conveyer 42. The fifth gear train 795 includes a gear 70K meshing with the input gear 70H in the second intermediate gear 70A, a gear 70L meshing with the gear 70K, and a gear 70M meshing with the gear 70L.

The gear 70L is a two-wheeler gear, in which an input gear 70N on the left and an output gear 70P on the right are formed integrally. The input gear 70N meshes with the gear 70K, and the output gear 70P meshes with the gear 70M.

The gear 70M may output the driving force to the driving roller 421 in the belt conveyer 42. The gear 70M is a two-wheeler gear, in which an input gear 70Q on the left and an output gear 70R on the right are formed integrally. The input gear 70Q meshes with the output gear 70P of the gear 70L, and the output gear 70R meshes with a gear (not shown) on the driving roller 421. Alternatively, the gear 70M may be a single-wheeler gear meshing with the output gear 70P and the gear on the driving roller 421.

The fifth gear train 795 has the gear 70K, which meshes with the second intermediate gear 70A. In other words, the fifth gear 795 is diverged from the second gear train 792 at the second intermediate gear 70A. In other word, the fifth gear train 795 diverged from the second gear train 792 at the second intermediate gear 70A, which is at a most upstream position in the second gear train 792; therefore, uneven rotation of the gears in one of the fifth gear train 795 and the second gear train 792 may be restrained from being transmitted to the other of the fifth gear train 795 and the second gear train 792.

(Reverse-Rotation Restrictive Mechanism)

Each of the first intermediate gear 70A and the gear 70L has a reverse-rotation restrictive mechanism 9. The reverse-rotation restrictive mechanism 9 may restrict the output gear 70J in the second intermediate gear 70A and the output gear 70P in the gear 70L from rotating reversely when the process motor 78 rotates reversely.

The input gear 70H has a cylindrical portion 701, which is centered at a rotation axis of the input gear 70H and protrudes rightward. The cylindrical portion 701 has a cutout, which is formed along a direction of the rotation axis. One and the other of circumferential end faces of the cutout forms a first contact portion 91 and a second contact portion 92, respectively.

The output gear 70J has a rotation-shaft portion 702, which is inserted in the cylindrical portion 701 in the input gear 70H to be rotatably supported, and a protrusive portion 93, which protrude in a radial direction from the rotation-shaft portion 702, in an inner area formed on an inner side of teeth. The protrusive portion 93 includes a third contact portion 931, which may contact the first contact portion 91, and a fourth contact portion 932, which may contact the second contact portion 92.

The reverse-rotation restrictive mechanism 9 may be formed at least of the first contact portion 91, the second contact portion 92, and the protrusive portion 93. When the process motor 78 rotates normally, the third contact portion 931 in the protrusive portion 93 may contact the first contact portion 91, as drawn in solid lines in FIG. 7, so that the input gear 70H and the output gear 70J rotate integrally.

Figure 7:
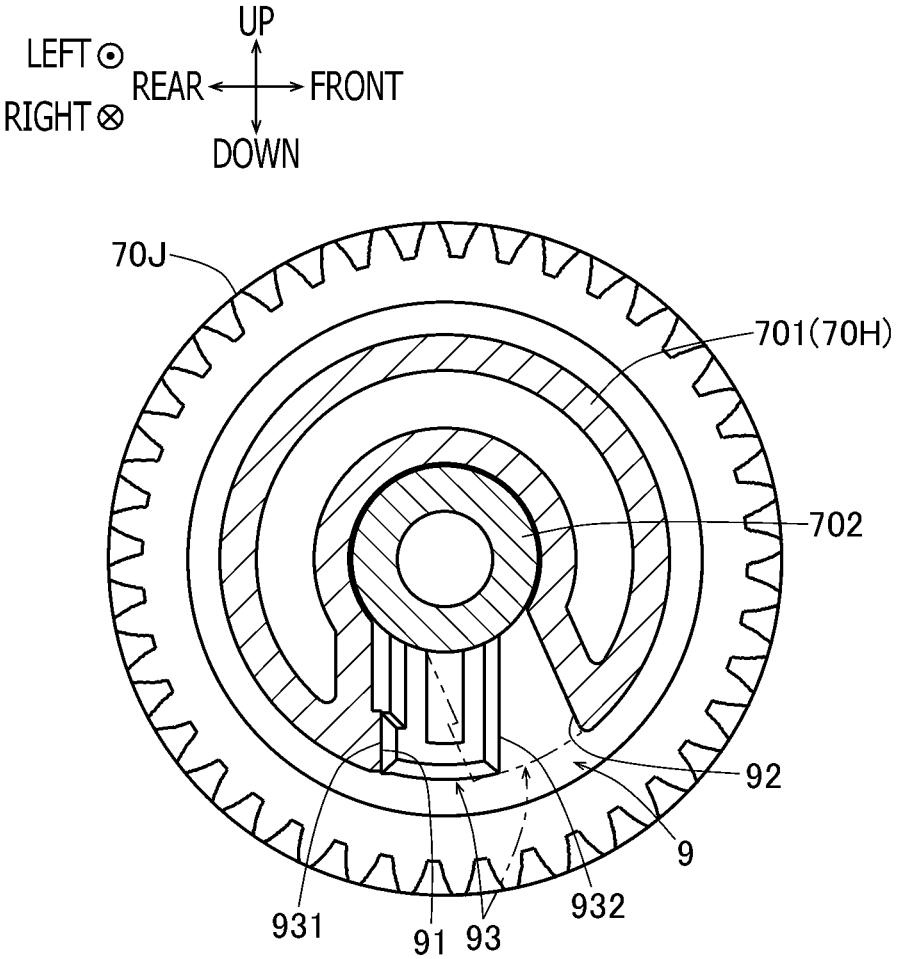
FIG. 7 is a cross-sectional view of the second intermediate gear in the image forming apparatus according to the embodiment of the present disclosure viewed at a section B-B in FIG. 6.

On the other hand, when the process motor 78 is switched to rotate reversely, the third contact portion 931 may be separated from the protrusive portion 91, and the fourth contact portion 932 may contact the second contact portion 92, as drawn in dash-and-dots lines in FIG. 7. During this movement, after the protrusive portion 93 separates from the first contact portion 91 and until the protrusive portion 93 contacts the second contact portion 92, the input gear 70H may idle with respect to the output gear 70J so that the output gear 70J may not rotate. Therefore, for a time period while the input gear 70H idles, the output gear 70J may be restricted from rotating reversely.

The reverse-rotation restrictive mechanism in the gear 70L is in the same form as the reverse-rotation restrictive mechanism 9 in the second intermediate gear 70A described above; therefore, detailed description of the reverse-rotation restrictive mechanism in the gear 70L is herein omitted.

With the reverse-rotation restrictive mechanism 9, when the process motor 78 is rotated reversely temporarily in order to separate the pendulum gear 79D from the input gear 79M, noise that may otherwise be produced by the pendulum gear 79M may be restrained, and the first through fourth photosensitive drums 55A-55D and the belt conveyer 42 may be restrained from rotating reversely. An amount to rotate the process motor 78 reversely may be, for example, an amount equivalent to a tooth or two teeth.

Alternatively, the first contact portion 91 and the second contact portion 92 may be arranged on the output gear 70J, and the protrusive portion 93 may be arranged on the input gear 70H. In other words, the reverse-rotation restrictive mechanism 9 may be formed of at least two gears arranged coaxially, one of which has the protrusive portion 93, and the other of which has the first contact portion 91 and the second portion 92.

Alternatively, for another example, the reverse-rotation restrictive mechanism 9 may not necessarily be arranged in the second intermediate gear 70A or the gear 70L but may be arranged in other gears in the second gear train 792 and the fifth gear train 795.

<First Cover>

Figure 2:
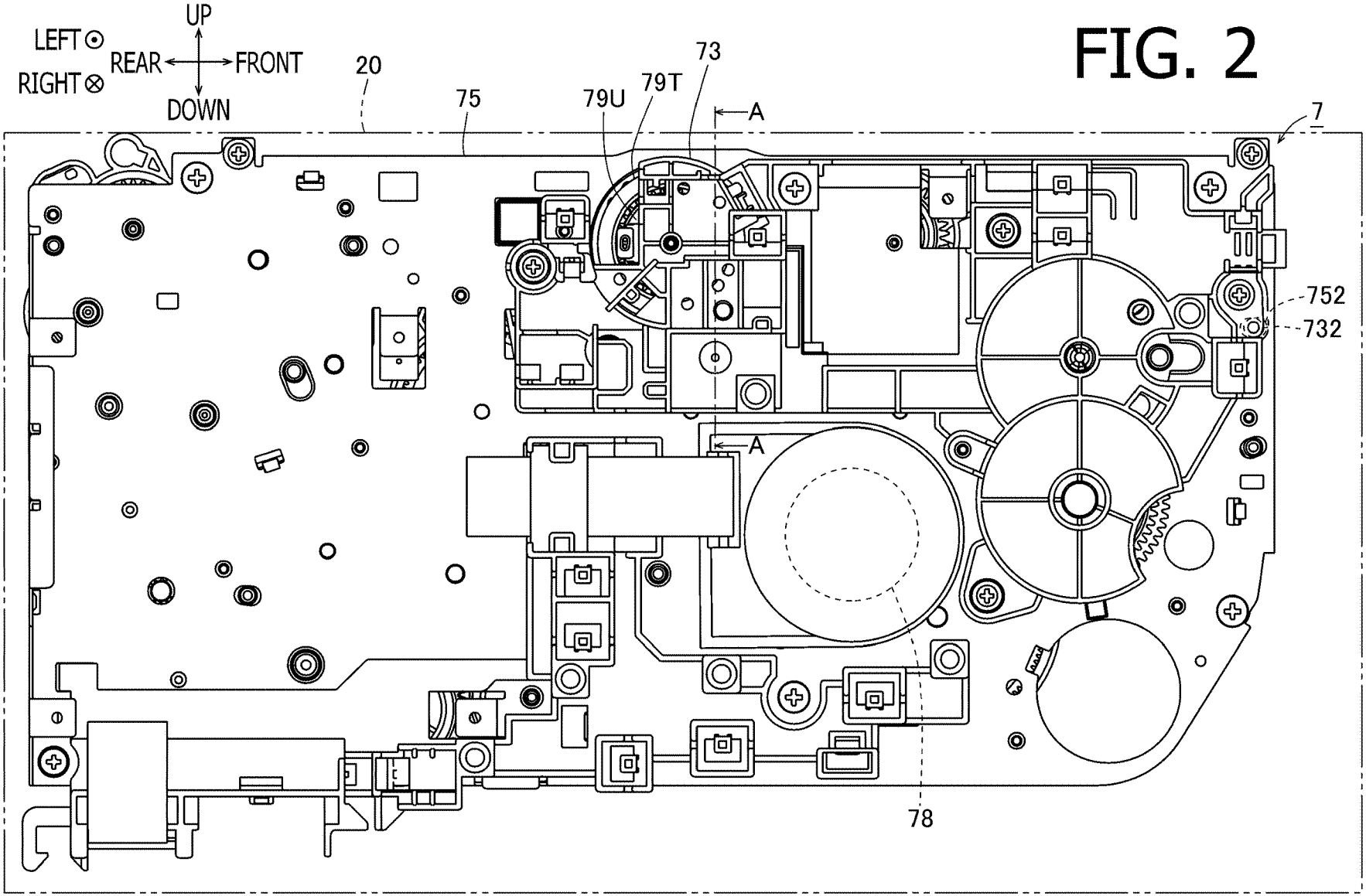
FIG. 2 is a leftward side view of a driving device in the image forming apparatus according to the embodiment of the present disclosure.
Figure 8:
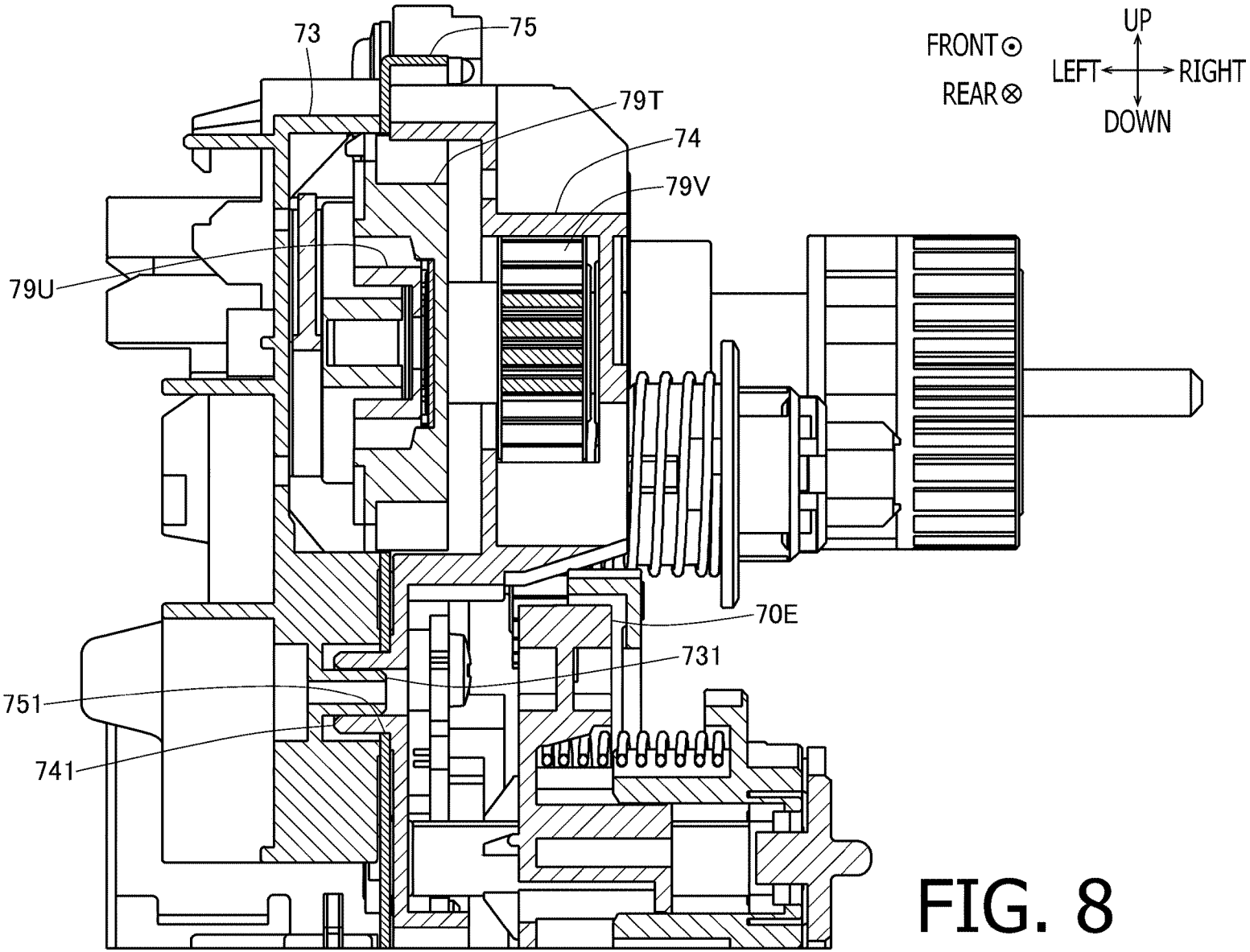
FIG. 8 is a cross-sectional view of the driving device in the image forming apparatus according to the embodiment of the present disclosure viewed at a section A-A in FIG. 2.

The first cover 73 may be made of resin and is, as shown in FIG. 2, fixed to one side of the metal plate member 75 and supports the electromagnetic clutch 79U. In the present embodiment, the first cover 73 is fastened to a leftward face of the metal plate member 75 by screws. The first cover 73 has a first engageable portion 731, as shown in FIG. 8, which engages with a second engageable portion 741 in the second cover 74, and a third engageable portion 732, as shown in FIGS. 2 and 4, which engages with an elongated hole 752 in the metal plate member 75. The first engageable portion 731 and the third engageable portion 732 may be cylindrical bosses, which protrude toward the metal plate member 75.

<Second Cover>

Figure 3:
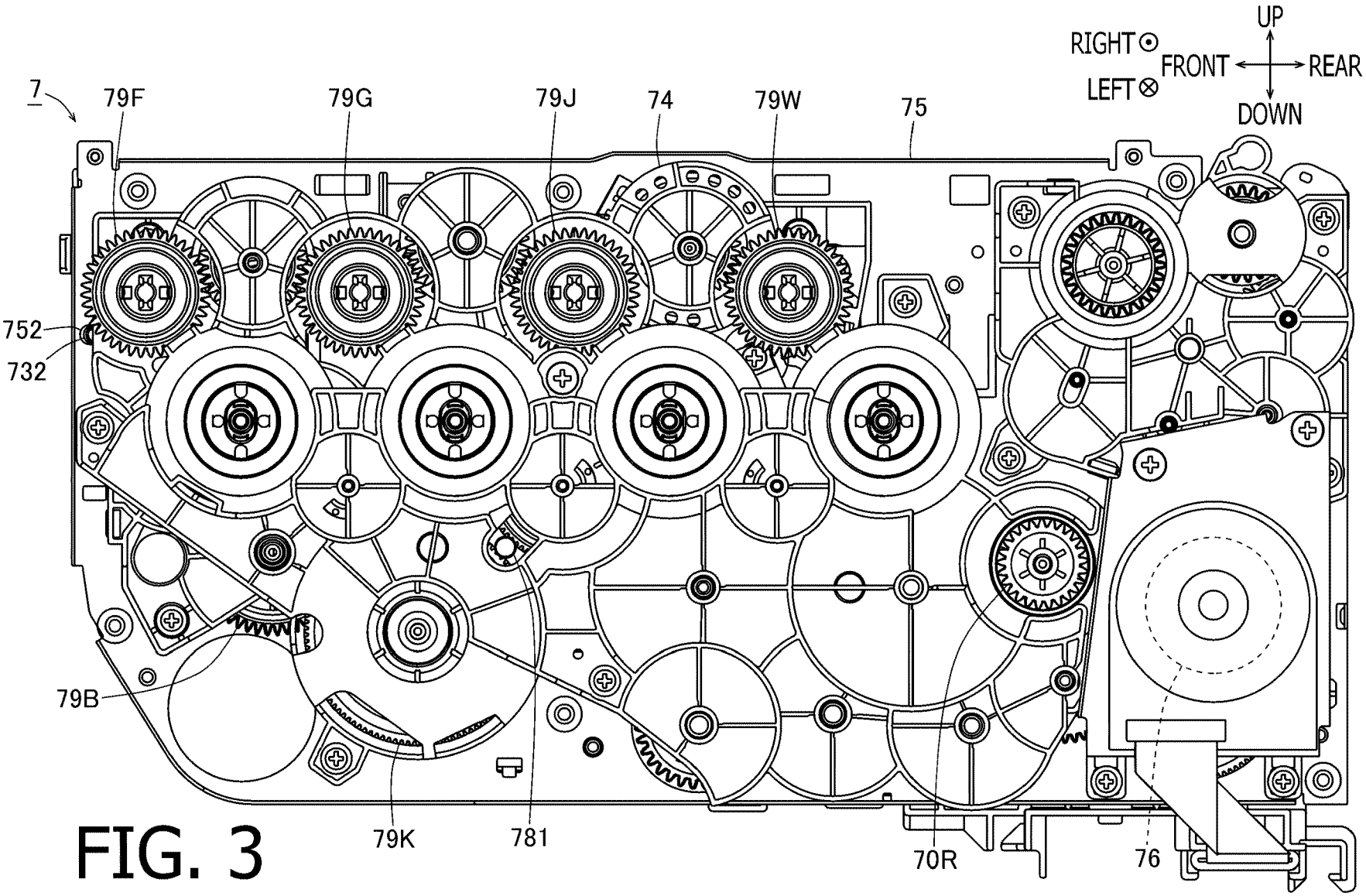
FIG. 3 is a rightward side view of the driving device in the image forming apparatus according to the embodiment of the present disclosure.

The second cover 74 may be made of resin and is, as shown in FIG. 3, fixed to the other side of the metal plate member 75 and supports an end of the clutch-output gear 79V. In the present embodiment, the second cover 74 is fastened to a rightward face of the metal plate member 75 by screws. As shown in FIG. 8, the second cover 74 has the second engageable portion 741, which engages with the first engageable portion 731 in the first cover 73 and a positioning hole 751 in the metal plate member 75. The second engageable portion may be a cylindrical boss, which protrudes toward the metal plate member 75.

<Metal Plate Member>

The metal plate member 75 may be a sheet of metal to support the first through fifth gear trains 791-795, the first cover 73, and the second cover 74. As shown in FIG. 8, the metal plate member 75 has the positioning hole 751, which is a round hole engageable with the second engageable portion 741 in the first cover 73.

With the first cover 73, the second cover 74, and the metal plate member 75 formed as above, an outer circumferential surface of the second engageable portion 41 may engage with the positioning hole 751 in the metal plate member 75, and an inner circumferential surface of the second engageable portion 741 may engage with an outer circumferential surface of the first engageable portion 731. Therefore, the second cover 74 may be placed at a correct position on the metal plate member 75, and the first cover 73 may be placed at a correct position on the second cover 74. In this arrangement, the electromagnetic clutch 79U, which is supported by the first cover 73, and the clutch-output gear 79V, which is supported by the second cover 74, may be placed at correct positions to one another.

As shown in FIGS. 2 and 4, the metal plate 75 has the elongated hole 752, which engages with the third engageable portion 732 in the first cover 73. Therefore, a worker assembling the image forming apparatus 1 may engage the third engageable portion 732 with the elongated hole 752, and thereafter, with the third engageable portion 732 engaged with the elongated hole 752, the worker may attach the first cover 73 to the metal plate member 75, to which the second cover 74 is attached. According to this procedure, the first cover 73 may be restrained from rotating about the first engageable portion 731. Therefore, productivity by the worker may be improved.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. An image forming apparatus, comprising:

a first developing roller, a second developing roller, and a third developing roller, each configured to carry a developing agent in one of different colors other than black;

a fourth developing roller configured to carry a developing agent in black;

a first photosensitive drum corresponding to the first developing roller;

a second photosensitive drum corresponding to the second developing roller;

a third photosensitive drum corresponding to the third developing roller;

a fourth photosensitive drum corresponding to the fourth developing roller;

a motor configured to drive the first developing roller, the second developing roller, the third developing roller, the fourth developing roller, the first photosensitive drum, the second photosensitive drum, the third photosensitive drum, and the fourth photosensitive drum;

a first output gear arranged coaxially with the motor, the first output gear being configured to output a driving force from the motor;

a first gear train including a first intermediate gear, the first intermediate gear meshing with the first output gear, the first gear train being configured to transmit the driving force from the motor through the first output gear to the first developing roller, the second developing roller, the third developing roller, and the fourth developing roller; and a second gear train including a second intermediate gear, the second intermediate gear meshing with the first output gear, the second gear train being configured to transmit the driving force from the motor through the first output gear to the first photosensitive drum, the second photosensitive drum, the third photosensitive drum, and the fourth photosensitive drum.

2. The image forming apparatus according to claim 1, wherein the first gear train includes:

a third gear train configured to transmit the driving force to the first developing roller, the second developing roller, and the third developing roller; and a fourth gear train configured to transmit the driving force to the fourth developing roller, wherein the third gear train includes a pendulum gear arranged upstream from the first developing roller, the second developing roller, and the third developing roller in a transmission flow of the driving force, the pendulum gear being swingable between a first position, in which the pendulum gear transmits the driving force downstream in the transmission flow, and a second position, in which the driving force is disconnected, and wherein the fourth gear train includes an electromagnetic clutch arranged upstream from the fourth developing roller in a transmission flow of the driving force, the electromagnetic clutch being configured to shift between a first state, in which the electromagnetic clutch transmits the driving force downstream in the transmission flow, and a second state, in which the electromagnetic clutch disconnects the driving force.

3. The image forming apparatus according to claim 2, wherein the third gear train includes the first intermediate gear, and wherein the fourth gear train is diverged from the third gear train at a position upstream from the pendulum gear.

4. The image forming apparatus according to claim 3, wherein the third gear train includes a third intermediate gear meshing with the first intermediate gear, and wherein the fourth gear train is diverged from the third gear train at the third intermediate gear.

5. The image forming apparatus according to claim 2, wherein one of gears in the third gear train and one of gears in the fourth gear train are arranged coaxially.

6. The image forming apparatus according to claim 5, wherein the third developing roller is arranged adjacent to the fourth developing roller, and wherein the one of the gears in the third gear train is a second output gear arranged coaxially with the third developing roller, the second output gear being configured to output the driving force to the third developing roller.

7. The image forming apparatus according to claim 2, wherein the fourth gear train includes:

a clutch-input gear configured to input the driving force to the electromagnetic clutch; and a clutch-output gear having teeth, of which quantity is different from a quantity of teeth in the clutch-input gear, the clutch-output gear being configured to output the driving force from the electromagnetic clutch.

8. The image forming apparatus according to claim 7, wherein the fourth gear train includes a second output gear arranged coaxially with the fourth developing roller, the second output gear being configured to output the driving force to the fourth developing roller, and wherein the clutch-output gear meshes with the second output gear.

9. The image forming apparatus according to claim 7, further comprising:

a metal plate member having a positioning hole, the metal plate member supporting the fourth gear train;

a first cover having a first engageable portion, the first cover being fixed to one side of the metal plate member, the first cover supporting the electromagnetic clutch; and a second cover having a second engageable portion, the second engageable portion engaging with the positioning hole and the first engageable portion, the second cover being fixed to the other side of the metal plate member, the second cover supporting an end of the clutch-output gear.

10. The image forming apparatus according to claim 1, wherein the first gear train includes a first gear, a second gear, a third gear, and a fourth gear configured to transmit the driving force from the motor to the first developing roller, the second developing roller, the third developing roller, and the fourth developing roller, respectively, the first gear, the second gear, the third gear, and the fourth gear aligning along a horizontal direction in this recited order.

11. The image forming apparatus according to claim 1, further comprising:

a belt conveyer facing the first photosensitive drum, the second photosensitive drum, the third photosensitive drum, and the fourth photosensitive drum, the belt conveyer being configured to convey a sheet; and a third gear train diverged from the second gear train at the second intermediate gear, the third gear train being configured to transmit the driving force to the belt conveyer.

12. The image forming apparatus according to claim 11, wherein each of the second gear train and the third gear train has a reverse-rotation restrictive mechanism configured to restrain gears in the second gear train and the third gear train from rotating reversely when the motor rotates reversely, wherein the revere-rotation restrictive mechanism includes two gears arranged coaxially, one of which has a protrusive portion, and the other of which has a first contact portion and a second contact portion, the protrusive portion being configured to contact one of the first contact portion and the second contact portion, wherein, when the motor rotates normally, the protrusive portion is configured to contact the first contact portion, the protrusive portion contacting the first contact portion causing the two gears to rotate, and wherein, when the motor is switched to rotate reversely, the protrusive portion is configured to separate from the first contact portion and contact the second protrusive portion, the protrusive portion separating from the protrusive portion being configured to cause the two gears to rotate idly with respect to each other until the protrusive portion contacts the second contact portion.

13. The image forming apparatus according to claim 1, wherein the second gear train includes a first transmitting gear, a second transmitting gear, a third transmitting gear, and a fourth transmitting gear configured to transmit the driving force from the motor to the first photosensitive drum, the second photosensitive drum, the third photosensitive drum, and the fourth photosensitive drum, respectively, the first transmitting gear, the second transmitting gear, the third transmitting gear, and the fourth transmitting gear aligning along a horizontal direction in this recited order.

14. The image forming apparatus according to claim 13, wherein the second transmitting gear is arranged coaxially with the second photosensitive drum, and the third transmitting gear is arranged coaxially with the third photosensitive drum, and wherein the second intermediate gear is disposed between the second transmitting gear and the third transmitting gear in the horizontal direction.

* * * * *